US011878222B2

(12) United States Patent
Yamashita et al.

(10) Patent No.: US 11,878,222 B2
(45) Date of Patent: Jan. 23, 2024

(54) BAT

(71) Applicant: MIZUNO CORPORATION, Osaka (JP)

(72) Inventors: Yohei Yamashita, Osaka (JP); Katsuhisa Hirano, Osaka (JP)

(73) Assignee: Mizuno Corporation, Osaka (JP)

( * ) Notice: Subject to any disclaimer, the term of this patent is extended or adjusted under 35 U.S.C. 154(b) by 45 days.

(21) Appl. No.: 17/585,944

(22) Filed: Jan. 27, 2022

(65) Prior Publication Data

US 2023/0233915 A1 Jul. 27, 2023

(51) Int. Cl.

| | |
|---|---|
| ***A63B 60/54*** | (2015.01) |
| ***A63B 59/50*** | (2015.01) |
| *A63B 102/18* | (2015.01) |

(52) U.S. Cl.

CPC ..... *A63B 60/54* (2015.10); *A63B 59/50* (2015.10); *A63B 2102/18* (2015.10); *A63B 2102/182* (2015.10); *A63B 2209/00* (2013.01)

(58) Field of Classification Search

CPC ..... A63B 60/54; A63B 59/50; A63B 2102/18; A63B 2102/182

See application file for complete search history.

(56) References Cited

U.S. PATENT DOCUMENTS

| | | | | |
|---|---|---|---|---|
| 7,798,926 | B1 * | 9/2010 | Hsu | A63B 59/51 473/566 |
| 7,985,149 | B2 * | 7/2011 | Watari | A63B 59/50 473/566 |
| 10,220,277 | B1 * | 3/2019 | Hunt | A63B 59/42 |
| 10,245,488 | B1 * | 4/2019 | Kays | A63B 60/54 |
| 10,561,914 | B2 * | 2/2020 | Tsukamoto | A63B 59/50 |
| 11,660,512 | B2 * | 5/2023 | Hunt | A63B 59/51 473/564 |
| 2012/0108371 | A1 * | 5/2012 | Epling | A63B 59/51 473/566 |
| 2015/0273295 | A1 * | 10/2015 | Haas | A63B 59/50 473/520 |
| 2016/0184680 | A1 * | 6/2016 | Van Nguyen | A63B 59/54 29/527.1 |
| 2017/0340935 | A1 * | 11/2017 | Gray | A63B 60/54 |
| 2018/0015342 | A1 * | 1/2018 | Van Nguyen | A63B 60/08 |
| 2018/0065011 | A1 * | 3/2018 | Earley | A63B 60/42 |

OTHER PUBLICATIONS

Documen, The Mechanical Loss coeffficient (tan delta), https://dokumen.tips/documents/ the-mechanical-loss-coefficient-tan-delta.html?page=1, Jun. 2014.*

* cited by examiner

*Primary Examiner* — William M Pierce

(74) *Attorney, Agent, or Firm* — Troutman Pepper Hamilton Sanders LLP; James E. Schutz; Korbin M. Blunck

(57) ABSTRACT

A bat includes a handle having a proximate end and a distal end, a barrel having a hollow portion that accommodates the distal end, and a first damping section at least partially sandwiched between the handle and the barrel in the interior of the hollow portion. The material of the first damping section has a D hardness of 60 or more, a loss coefficient tan δ of 0.11 or more as determined under conditions of a temperature of 20° C., a frequency of 150 Hz, and the amount of strain 3000 μST, and a loss coefficient tan δ of 0.09 or more as determined under conditions of a temperature of 20° C., a frequency of 500 Hz, and the amount of strain 3000 μST.

15 Claims, 7 Drawing Sheets

100

BAT

BACKGROUND OF THE INVENTION

Field of the Invention

The present invention relates a bat for use in baseball and softball and specifically to a bat having shock absorbing capabilities.

Description of the Background Art

Bats having damping sections for damping vibrations in striking a ball are conventionally known. An example of such bats is a two-piece bat in which a handle and a barrel prepared as separate members are connected to each other by adhesive or the like and a damping section is arranged at a joint where the handle and the barrel are connected.

In general, the damping section is made of an elastic material having a Shore A hardness of 100 or less in order to reduce numbness and pain in hands that the user feels when striking a ball.

The bat described in U.S. Pat. No. 10,245,488 includes a first damping section and a second damping section. The first damping section comprises an elastic material, for example, having a Shore A hardness of 70 to 100 The second damping section comprises an elastic material, for example, having a Shore A hardness of 20 to 40.

SUMMARY OF THE INVENTION

The feel of striking a ball with the conventional bat having damping sections is too soft, and bats giving a hard feel compared with the conventional bat have been sought for.

A main object of the present invention is to provide a bat giving a hard feel compared with the conventional bat while reducing numbness and pain in hands that the user feels when striking a ball.

A bat according to embodiments of the present invention extends along the axial direction and includes a handle having a proximate end and a distal end, a barrel having a hollow portion that accommodates the distal end, and a first damping section at least partially sandwiched between the handle and the barrel. The material of the first damping section is a material having a D hardness of 60 or more, a loss coefficient tan δ of 0.11 or more as measured with the amount of strain 3000 μST, a temperature of 20° C., and a frequency of 150 Hz, and a loss coefficient tan δ of 0.09 or more as measured with the amount of strain 3000 μST, a temperature of 20° C., and a frequency of 500 Hz.

In the bat according to the present embodiment, the material of the first damping section has a D hardness of 60 or more. The D hardness is durometer D hardness defined by the Japanese Industrial Standards (JIS) K7215 (1986). The material having a D hardness of 65 or more has a durometer. A hardness (Shore A hardness) of almost 100 as defined by JIS K7215 (1986). The bat according to the present embodiment therefore gives a hard feel of striking a ball, compared with the conventional bat. Furthermore, the material of the first damping section has a loss coefficient tan δ of 0.11 or more as measured with the amount of strain 3000 μST, a temperature of 20° C. and a frequency of 150 Hz, and a loss coefficient tan δ of 0.09 or more as measured with the amount of strain 3000 μST, a temperature of 20° C., and a frequency of 500 Hz.

Because of this material, numbness and pain in hands that the user feels when striking a ball is reduced.

The foregoing and other objects, features, aspects and advantages of the present invention will become more apparent from the following detailed description of the present invention when taken in conjunction with the accompanying drawings.

It should be noted that the figures are not always drawn to scale.

DESCRIPTION OF THE PREFERRED EMBODIMENTS

Exemplary embodiments of the present invention will be described below with reference to the drawings.

Figure 1:
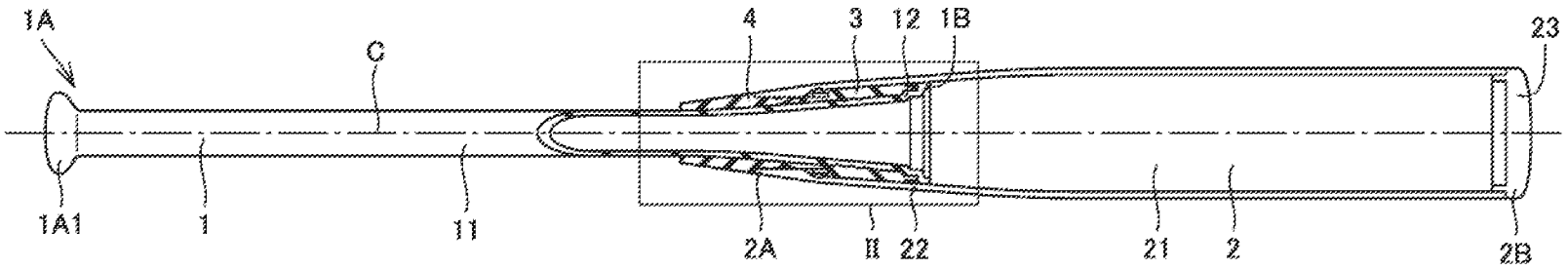
FIG. 1 is a partial cross-sectional view of a handle, a barrel, and a first damping section of a bat according to the present embodiment.

As shown in FIG. 1, a bat 100 according to embodiments includes a handle 1, a barrel 2, a first damping section 3, and a second damping section 4. Rat 100 has a center axis C. The center axis C passes through the center of each of handle 1, barrel 2, first damping section 3, and second damping section 4 in a cross section perpendicular to the center axis C. Region II in FIG. 1, and FIG. 2 to FIG. 4 are cross-sectional views along the center axis C of bat 100. Hereinafter, the axial direction along the center axis C will be simply referred to as axial direction, the radial direction with respect to the center axis C will be simply referred to as radial direction, and the circumferential direction around the center axis C will be simply referred to as circumferential direction. The cross section shown in FIG. 4 is different in the circumferential direction from the cross section shown in FIG. 2.

Bat 100 has a first bending mode and a second bending mode. In the first bending mode, a node is disposed at a position approximately 150 mm (approximately 6 inches) away from a proximate end 1A of handle 1 toward a distal end 1B. In the second bending mode, a node is disposed at a position approximately 50 mm (approximately 2 inches) away from proximate end 1A of handle 1 toward distal end 1B. The first bending mode of bat 100 has a natural frequency of, for example, 100 Hz to 300 Hz. The second bending mode of bat 100 has a natural frequency of, for example, 450 Hz to 900 Hz. The natural frequency of each of the first bending mode and the second bending mode of bat 100 may be determined by modal analysis.

As shown in FIG. 1, handle 1 has proximate end 1A and distal end 1B. Proximate end 1A and distal end 1B are one end and the other end in the axial direction of handle 1. Handle 1 has a substantially cylindrical shape. The thickness in the radial direction of handle 1 is substantially constant, for example, irrespective of the position in the axial direction.

Handle 1 includes a straight tube portion 11 having an outer diameter substantially constant irrespective of the position in the axial direction and a diameter-increasing portion 12 having an outer diameter gradually increasing toward distal end 1B in the axial direction. Straight tube portion 11 is at least partially exposed to the exterior of bat 100. Diameter-increasing portion 12 is at least partially accommodated in the interior of barrel 2. For example, the entire diameter-increasing portion 12 is accommodated in the interior of barrel 2. The proximate end of straight tube portion 11 forms proximate end 1A of handle 1. The outer diameter of straight tube portion 11 is the smallest diameter of handle 1. The distal end of straight tube portion 11 is connected to the proximate end of diameter-increasing portion 12. The distal end of diameter-increasing portion 12 forms distal end 1B of handle 1.

Figure 2:
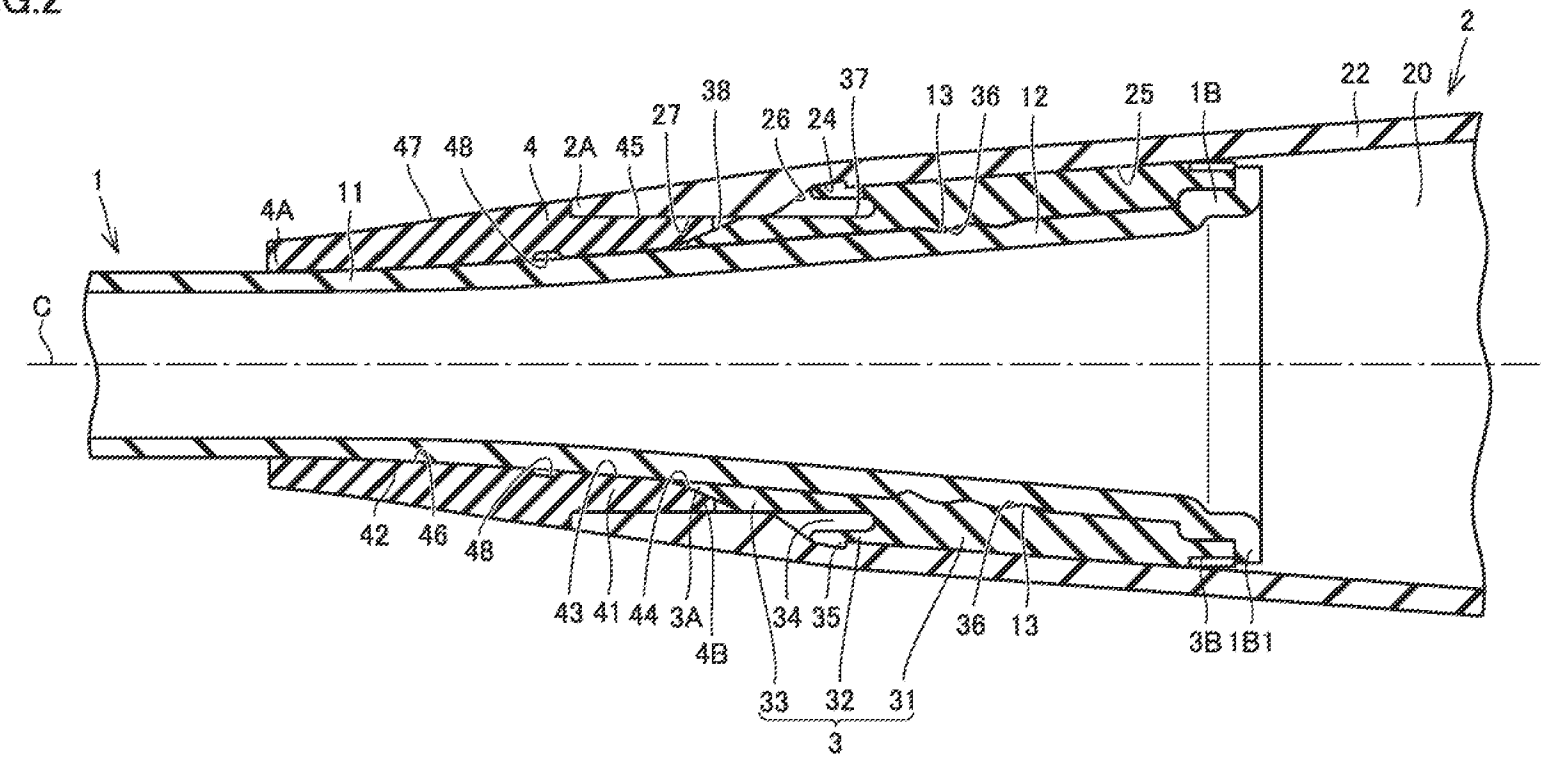
FIG. 2 is an enlarged cross-sectional view of a region II in FIG. 1.

As shown in FIG. 1 and FIG. 2, the outer peripheral surface of diameter-increasing portion 12 is inclined to form an acute angle with respect to the center axis C. As shown in FIG. 2, for example, a thread groove 13 is formed on the outer peripheral surface of diameter-increasing portion 12. Thread groove 13 is formed in a spiral manner around the center axis C.

As shown in FIG. 1, proximate end 1A has, for example, a knob 1A1. As shown in FIG. 2, distal end 1B has, for example, a lip 1B1, lip 1B1 protrudes outward in the radial direction from the outer peripheral surface of diameter-increasing portion 12 and has a wall surface facing toward proximate end 1A. The outer diameter of lip 1B1 is the largest diameter of barrel 2.

Knob 1A1 is formed, for example, as a member different from handle 1 and attached to handle 1 by any method such as adhesive. Lip 1B1 is formed, for example, as the same member as handle 1 Knob 1A1 may be formed as the same member as handle 1. Lip 1B1 may be formed as a member different from handle 1 and attached to handle 1 by any method such as adhesive.

The material of handle 1 includes, for example, at least one selected from the group consisting of metals, metal alloys, and fiber reinforced resins. The fiber reinforced resins include a matrix and fibers embedded in the matrix. The material of the matrix may be any resin material and include, for example, at least one of epoxy resin and polyester resin. The material of the matrix may include a thermoplastic polymer or a thermosetting polymer. The material of the fibers includes at least one selected from the group consisting of carbon, glass, aramid, and metal.

As shown in FIG. 1, barrel 2 has a proximate end 2A and a distal end 2B. Proximate end 2A and distal end 2B are one end and the other end in the axial direction of barrel 2. Proximate end 2A is disposed closer to proximate end 1A than distal end 1B. Distal end 2B is disposed farther from proximate end 1A than distal end 1B. Barrel 2 has a hollow portion 20 having an opening at proximate end 2A. The interior of hollow portion 20 accommodates a part closer to distal end 1B of diameter-increasing portion 12 of handle 1, the entire first damping section 3, and a part of second damping section 4.

Barrel 2 has a substantially cylindrical shape. The inner diameter of proximate end 2A of barrel 2 is smaller than, for example, the outer diameter of distal end 1B of handle 1. The inner diameter of distal end 2B of barrel 2 is larger than the outer diameter of distal end 1B of handle 1.

Barrel 2 has a straight tube portion 21, a diameter-decreasing portion 22, and a closing portion 23. Straight tube portion 21 is a portion where the outer diameter is substantially constant irrespective of the position in the axial direction. Straight tube portion 21 has a "sweet spot". The proximate end of straight tube portion 21 is connected to the distal end of diameter-decreasing portion 22. The distal end of straight tube portion 21 is an opening end. The opening diameter of the distal end of straight tube portion 21 is larger than the largest diameter of handle 1 This configuration enables handle 1 to be inserted into barrel 2 from the distal end side of straight tube portion 21 in a method of manufacturing a bat described later.

The inner peripheral surface of straight tube portion 21 of barrel 2 extends, for example, parallel to the center axis C. The inner peripheral surface of straight tube portion 21 of barrel 2 is not opposed to, for example, the outer peripheral surface of handle 1.

Diameter-decreasing portion 22 is a portion disposed closer to proximate end 1A than straight tube portion 21 and having an outer diameter gradually reducing toward proximate end 1A. The proximate end of diameter-decreasing portion 22 forms proximate end 2A of barrel 2. The proximate end of diameter-decreasing portion 22 is an opening end. At least a part of diameter-increasing portion 12 of handle 1 is accommodated in a partial region formed in the interior of diameter-decreasing portion 22 in the hollow portion. For example, the entire diameter-increasing portion 12 of handle 1 is accommodated in the partial region formed in the interior of diameter-decreasing portion 22 in the hollow portion. The opening diameter of the proximate end of diameter-decreasing portion 22 is smaller than the largest diameter of barrel 2 and larger than the smallest diameter of barrel 2 This configuration can restrict movement of handle 1 to the exterior of barrel 2 from the proximate end side of diameter-decreasing portion 22 in the method of manufacturing a bat described later.

The inner peripheral surface of diameter-decreasing portion 22 of barrel 2 is inclined to form an acute angle with respect to the center axis C. At least a part of the inner peripheral surface of diameter-decreasing portion 22 is opposed to the outer peripheral surface of diameter-increasing portion 12 of handle 1. At least a part of the inner peripheral surface of diameter-decreasing portion 22 is spaced apart from the outer peripheral surface of diameter-increasing portion 12 in the radial direction. At least a part of the inner peripheral surface of diameter-decreasing portion 22 is substantially parallel to the outer peripheral surface of diameter-increasing portion 12 Straight tube portion 21 and diameter-decreasing portion 22 are formed, for example, as the same member.

Closing portion 23 closes the distal end of straight tube portion 21. Closing portion 23 forms distal end 2B of barrel 2. Closing portion 23 is formed, for example, as a member different from straight tube portion 21.

The material of barrel 2 includes, for example, at least one selected from the group consisting of metals, metal alloys, and fiber reinforced resins. The fiber reinforced resins include a matrix and fibers embedded in the matrix. The material of the matrix may be any resin material and include, for example, at least one of epoxy resin and polyester resin. The material of the matrix may include a thermoplastic polymer or a thermosetting polymer. The material of the fibers includes at least one selected from the group consisting of carbon, glass, aramid, and metal.

As shown in FIG. 2, in a cross section along the center axis C, diameter-decreasing portion 22 of barrel 2 has at least one depression 24 on the inner peripheral surface. At least one depression 24 is opposed to the outer peripheral surface of diameter-increasing portion 12 in the radial direction. For example, diameter-decreasing portion 22 may have one depression 24 continuous in the circumferential direction. Diameter-decreasing portion 22 may have a plurality of depressions 24 spaced apart from each other in the circumferential direction.

The inner peripheral surface of diameter-decreasing portion 22 has a first inner peripheral surface 25 disposed relatively closer to distal end 2B, and a second inner peripheral surface 26 and a third inner peripheral surface 27 disposed closer to proximate end 2A than first inner peripheral surface 25. First inner peripheral surface 25 extends to the distal end of diameter-decreasing portion 22. The proximate end of first inner peripheral surface 25 is connected to, for example, the distal end of the one depression 24. The distal end of second inner peripheral surface 26 is connected to, for example, the proximate end of the one depression 24. The proximate end of second inner peripheral surface 26 is connected to the distal end of third inner peripheral surface 27. Third inner peripheral surface 27 extends to the proximate end of diameter-decreasing portion 22. Each of first inner peripheral surface 25 and second inner peripheral surface 26 is inclined with respect to the center axis C such that the inner diameter gradually decreases toward proximate end 2A in the axial direction. Third inner peripheral surface 27 extends substantially parallel to the center axis C.

The inclination angle formed by second inner peripheral surface 26 with respect to the center axis C is larger than, for example, the inclination angle formed by first inner peripheral surface 25 with respect to the center axis C. Depression 24, first inner peripheral surface 25, and second inner peripheral surface 26 are spaced apart in the radial direction from a portion of diameter-increasing portion 12 that is disposed closer to distal end 1B.

As shown in FIG. 2, first damping section 3 is at least partially sandwiched between handle 1 and barrel 2 in the interior of hollow portion 20. For example, the entire first damping section 3 is sandwiched between handle 1 and barrel 2 in the interior of hollow portion 20. First damping section 3 is provided to damp the first bending mode of vibration.

The material of first damping section 3 is a material having a D hardness of 60 or more, a loss coefficient tan δ of 0.11 or more as measured with the amount of strain 3000 μST, a temperature of 20° C., and a frequency of 150 Hz, and a loss coefficient tan δ of 0.09 or more as measured with the amount of strain 3000 μST, a temperature of 20° C., and a frequency of 500 Hz.

Preferably, the material of first damping section 3 is a material having a D hardness of 65 or more, a loss coefficient tan δ of 0.12 or more as measured with the amount of strain 3000 μST, a temperature of 20° C., and a frequency of 150 Hz, and a loss coefficient tan δ of 0.10 or more as measured with the amount of strain 3000 μST, a temperature of 20° C., and a frequency of 500 Hz.

More preferably, the material of first damping section 3 is a material having a D hardness of 70 or more, a loss coefficient tan δ of 0.13 or more as measured with the amount of strain 3000 μST, a temperature of 20° C., and a frequency of 150 Hz, and a loss coefficient tan δ of 0.11 or more as measured with the amount of strain 3000 μST, a temperature of 20'C, and a frequency of 500 Hz.

More preferably, the material of first damping section 3 is a material having a D hardness of 70 or more, a loss coefficient tan δ of 0.14 or more as measured with the amount of strain 3000 μST, a temperature of 20° C., and a frequency of 150 Hz, and a loss coefficient tan δ of 0.12 or more as measured with the amount of strain 3000 μST, a temperature of 20° C., and a frequency of 500 Hz.

More preferably, the material of first damping section 3 is a material having a D hardness of 70 or more, a loss coefficient tan δ of 0.15 or more as measured with the amount of strain 3000 μST, a temperature of 20° C., and a frequency of 150 Hz, and a loss coefficient tan δ of 0.13 or more as measured with the amount of strain 3000 μST, a temperature of 20° C., and a frequency of 500 Hz.

More preferably, the material of first damping section 3 is a material having a D hardness of 70 or more, a loss coefficient tan δ of 0.15 or more as measured with the amount of strain 3000 μST, a temperature of 20° C., and a frequency of 150 Hz, and a loss coefficient tan δ of 0.14 or more as measured with the amount of strain 3000 μST, a temperature of 20° C., and a frequency of 500 Hz.

More preferably, the material of first damping section 3 is a material having a D hardness of 75 or more, a loss coefficient tan δ of 0.16 or more as measured with the amount of strain 3000 μST, a temperature of 20° C., and a frequency of 150 Hz, and a loss coefficient tan δ of 0.15 or more as measured with the amount of strain 3000 μST, a temperature of 20° C., and a frequency of 500 Hz.

The D hardness is durometer D hardness defined by the Japanese Industrial Standards (JIS) K7215 (1986). The D hardness of the material of first damping section 3 is measured based on the durometer D hardness measurement method defined by JIS K7215 (1986). The material having a D hardness of 65 or more has a durometer. A hardness (Shore A hardness) of almost 100 as defined by JIS K7215 (1986). The D hardness of the material of first damping section 3 is 100 or less, for example, 95 or less. The D hardness of the material of first damping section 3 may be 90 or less.

The loss coefficient tan δ of the material of first damping section 3 is measured based on the viscoelasticity testing method defined by JIS K7244 (2007).

The material of first damping section 3 may be any material that has the D hardness and the loss coefficient tan δ described above, and an example thereof is a polyamide-based elastomer. A non-limiting example of the polyamide included in first damping section 3 is nylon. A specific example of the material of first damping section 3 is S133 manufactured by TORAY INDUSTRIES, INC. Another example of the material of first damping section 3 is polyamide 11 (for example, PA11/BMNO17 manufactured by Arkema K. K.), polyamide 66 (for example, AZ3/2 manufactured by Ems-Chemie Ltd. or U328TL, manufacture by TORAY INDUSTRIES, INC), or nylon 6 (for example, 6 natural manufactured by Ensinger).

As shown in FIG. 2, first damping section 3 is sandwiched between the outer peripheral surface of diameter-increasing portion 12 of handle 1 and the inner peripheral surface of diameter-decreasing portion 22 of barrel 2. First damping section 3 is in contact with, for example, each of the outer peripheral surface of diameter-increasing portion 12, and first inner peripheral surface 25, second inner peripheral surface 26, and third inner peripheral surface 27 of diameter-decreasing portion 22. First damping section 3 has a substantially cylindrical shape.

As shown in FIG. 2, first damping section 3 includes a first portion 31, a second portion 32, and a third portion 33. Each of first portion 31, second portion 32, and third portion 33 is an annular portion continuous in the circumferential direction.

As shown in FIG. 2, first portion 31 is in contact with each of the outer peripheral surface of handle 1 and the inner peripheral surface of barrel 2 in the interior of hollow portion 20. Furthermore, first portion 31 is in contact with the wall surface of lip 1B1 that faces toward proximate end 1A of handle 1. First portion 31 has an inner peripheral surface in contact with the outer peripheral surface of diameter-increasing portion 12, an outer peripheral surface in contact with first inner peripheral surface 25 of diameter-decreasing portion 22, and an end surface in contact with the wall surface of lip 1B1. The distal end of first portion 31 forms distal end 3B of first damping section 3.

As shown in FIG. 2, each of second portion 32 and third portion 33 is disposed closer to proximate end 2A than first portion 31. Second portion 32 is in contact with the inner peripheral surface of barrel 2 but is not in contact with the outer peripheral surface of handle 1. Second portion 32 has an outer peripheral surface in contact with first inner peripheral surface 25 of diameter-decreasing portion 22 and an inner peripheral surface spaced apart from the outer peripheral surface of diameter-increasing portion 12 in the radial direction. The inner peripheral surface of second portion 32 is not in contact with the outer peripheral surface of diameter-increasing portion 12 and faces a gap 34.

As shown in FIG. 2, in a cross section along the center axis C, the outer peripheral surface of second portion 32 of first damping section 3 has at least one protrusion 35. At least one protrusion 35 is fitted in one depression 24. For example, second portion 32 has one protrusion 35 continuous in the circumferential direction. Second portion 32 may have a plurality of protrusions 35 spaced apart from each other in the circumferential direction. The height in the radial direction of protrusion 35 is equal to the depth in the radial direction of depression 24. Protrusion 35 and depression 24 fitted to each other restrict movement of first damping section 3 relative to barrel 2 in the axial direction.

As shown in FIG. 2, third portion 33 is disposed on the inside of second portion 32 in the radial direction and spaced apart from second portion 32 with gap 34 interposed. Third portion 33 protrudes toward proximate end 1A relative to second portion 32 in the axial direction. The proximate end of third portion 33 forms the proximate end of first damping section 3 Third portion 33 has an inner peripheral surface in contact with the outer peripheral surface of handle 1, a first outer peripheral surface 37 facing gap 34, and a second outer peripheral surface 38 disposed closer to proximate end 1A than first outer peripheral surface 37. A part of first outer peripheral surface 37 that is located closer to the distal end is opposed to the inner peripheral surface of second portion 32. A part of first outer peripheral surface 37 that is located closer to the proximate end is in contact with third inner peripheral surface 27 of diameter-decreasing portion 22 of barrel 2. The proximate end of first outer peripheral surface 37 is connected to the distal end of second outer peripheral surface 38. Second outer peripheral surface 38 faces toward proximate end 1A in the axial direction and faces outward in the radial direction.

As shown in FIG. 2, gap 34 is open to the side closer to proximate end 2A. The distance in the radial direction of gap 34 is equal to or larger than the height in the radial direction of protrusion 35. The interior of gap 34 is filled with, for example, gas such as air. The interior of gap 34 may be filled with any material.

Figure 3:
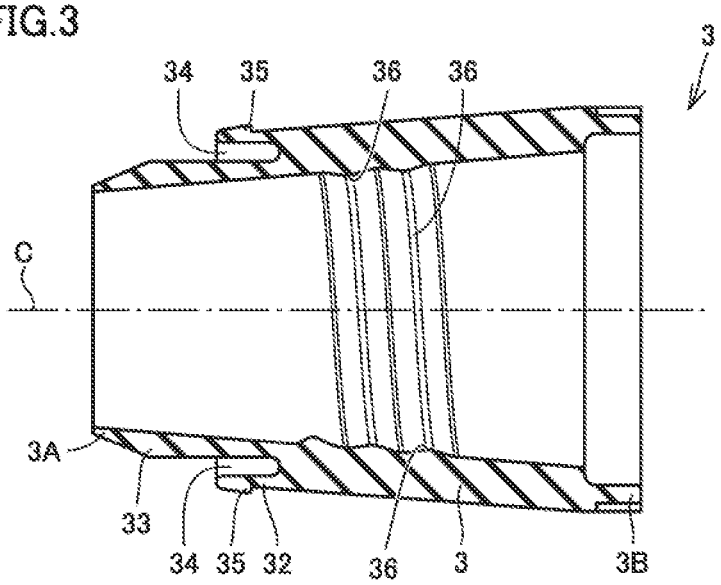
FIG. 3 is a cross-sectional view of the first damping section shown in FIG. 1 and FIG. 2.
Figure 4:
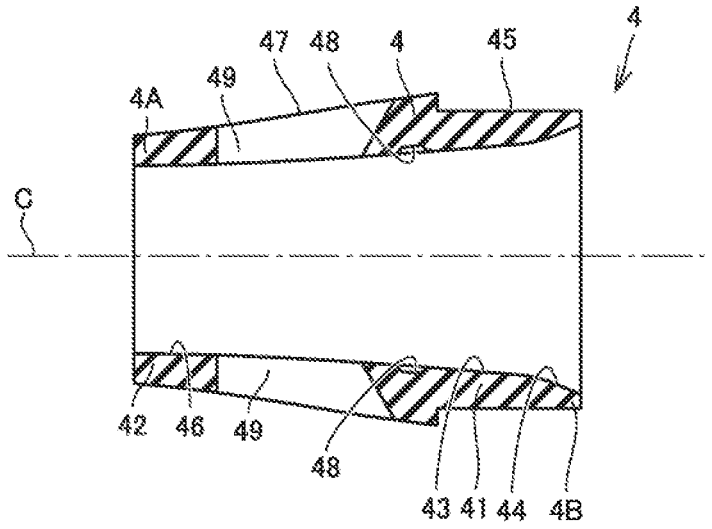
FIG. 4 is a cross-sectional view of a second damping section shown in FIG. 1 and FIG. 2, in which the cross section shown in FIG. 2 is rotated in a circumferential direction around the center axis.

As shown in FIG. 2 and FIG. 3, for example, a thread ridge 36 is formed on the inner peripheral surface of first portion 31. Thread ridge 36 is provided so as to be screwed on thread groove 13 formed at diameter-increasing portion 12 of handle 1. Thread groove 13 and thread ridge 36 screwed on each other restrict movement of first damping section 3 relative to handle 1 in the axial direction.

As shown in FIG. 2, second damping section 4 is disposed closer to proximate end 1A than first damping section 3 and at least partially sandwiched between handle 1 and barrel 2 in the interior of hollow portion 20. Second damping section 4 is provided to damp the second bending mode of vibration.

The D hardness of the material of second damping section 4 is lower than the D hardness of the material of first damping section 3. The A hardness of the material of second damping section 4 is lower than the A hardness of the material of first damping section 3 and, for example, 20 to 40. The A hardness is durometer. A hardness defined by JIS K7215 (1986). The A hardness of the material of second damping section 4 is measured based on the D hardness measurement method defined by JIS K7215 (1986). The material having an A hardness of 40 or less has a durometer D hardness lower than as defined by JIS K7215 (1986).

The material of second damping section 4 may be any material that has the A hardness described above and may be, for example, silicone, rubber, or urethane. Second damping section 4 has a substantially cylindrical shape.

As shown in FIG. 2, second damping section 4 has an accommodated portion 41 accommodated in hollow portion 20 of barrel 2 and an exposed portion 42 exposed to the exterior of barrel 2. The distal end of accommodated portion 41 forms the distal end of second damping section 4. The proximate end of exposed portion 42 forms the proximate end of second damping section 4.

As shown in FIG. 2, accommodated portion 41 is sandwiched between the outer peripheral surface of diameter-increasing portion 12 of handle 1 and the inner peripheral surface of diameter-decreasing portion 22 of barrel 2. Accommodated portion 41 has a fourth inner peripheral surface 43 in contact with, for example, the outer peripheral surface of diameter-increasing portion 12, a fifth inner peripheral surface 44 in contact with at least a pan of second outer peripheral surface 38 of third portion 33 of first damping section 3, and an outer peripheral surface 45 in contact with third inner peripheral surface 27 of diameter-decreasing portion 22.

As shown in FIG. 2, exposed portion 42 has a sixth inner peripheral surface 46 in contact with the outer peripheral surface of each of straight tube portion 11 and diameter-increasing portion 12, and an outer peripheral surface 47 exposed to the exterior.

As shown in FIG. 2, sixth inner peripheral surface 46 of exposed portion 42 of second damping section 4 has at least one depression 48. At least one depression 48 is provided in the form of a groove to be filled with a not-shown adhesive. For example, second damping section 4 has one depression 48 continuous in the circumferential direction. Second damping section 4 may have a plurality of depressions 48 spaced apart from each other in the circumferential direction.

As shown in FIG. 4, second damping section 4 may have a plurality of depressions 49 depressed relative to the outer peripheral surface of exposed portion 42. A plurality of depressions 49 are spaced apart from each other such that exposed portion 42 is sandwiched in the circumferential direction. Each of depressions 49 may be formed as an opening that exposes the outer peripheral surface of handle 1. Depressions 49 may be formed closer to proximate end 4A than depression 48.

Bat 100 may be manufactured, for example, by the following method.

First, handle 1, and straight tube portion 21 and diameter-decreasing portion 22 of barrel 2 are prepared. Handle 1 is formed, for example, by internal pressure forming. Straight tube portion 21 and diameter-decreasing portion 22 of barrel 2 are formed, for example, by internal pressure forming. Proximate end 1A of handle 1 does not have knob 1A1. Distal end 1B of handle 1 has lip 1B1. The distal end of straight tube portion 21 of barrel 2 is open.

Second, first damping section 3 is provided around diameter-increasing portion 12 of handle 1. For example, first damping section 3 is formed by any method such as injection molding and thereafter passed onto straight tube portion 11 from the proximate end 1A side of handle 1 and attached to diameter-increasing portion 12. First damping section 3 may be formed on the outer peripheral surface of diameter-increasing portion 12 of handle 1 by overmolding.

Figure 5:
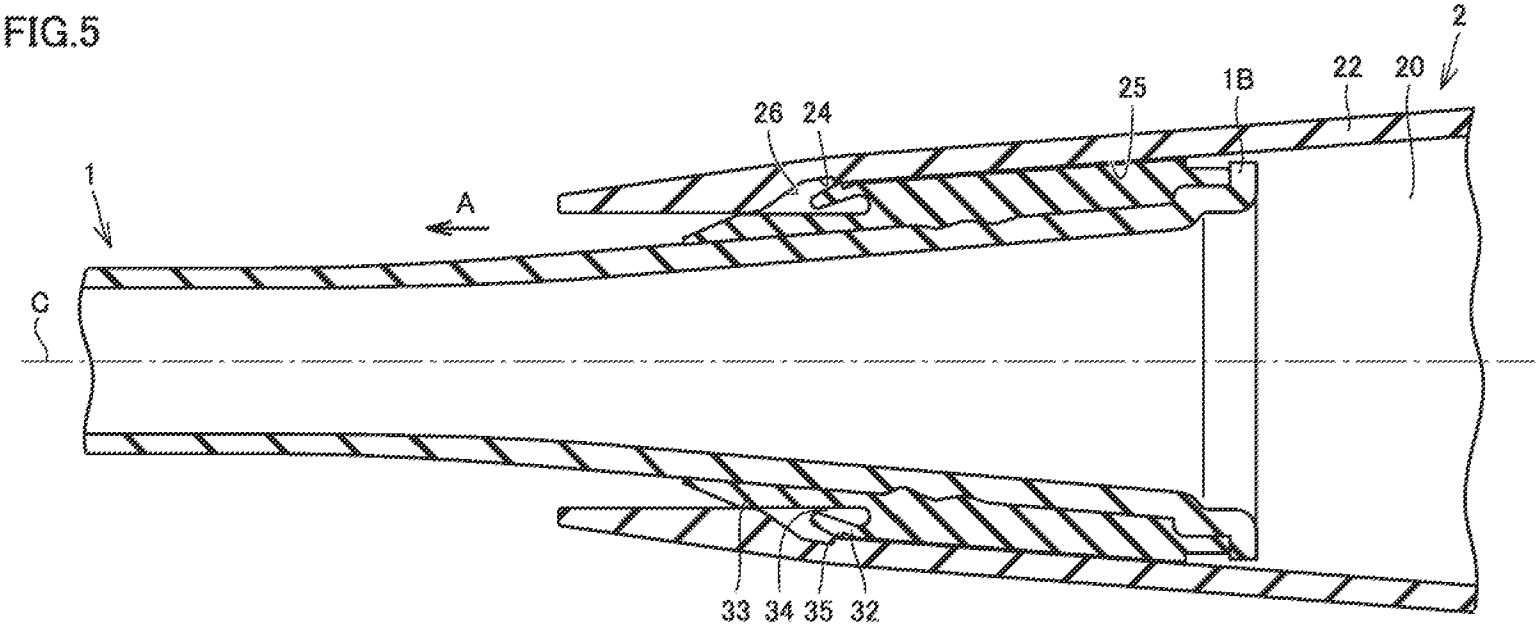
FIG. 5 is a cross-sectional view illustrating the step of inserting the first damping section attached to the handle into a hollow portion of the barrel in an exemplary method of manufacturing a bat according to the present embodiment.

Third, handle 1 having first damping section 3 attached thereto is inserted into hollow portion 20 of barrel 2. Handle 1 is inserted starting from proximate end 1A into hollow portion 20 through the distal end of straight tube portion 21, and finally, distal end 1B of handle 1 and first damping section 3 are also inserted into hollow portion 20. In this process of insertion, protrusion 35 comes into contact with first inner peripheral surface 25 located closer to distal end 2B than depression 24 and thereafter moves closer to depression 24 in the axial direction. With this process, as shown in FIG. 5, second portion 32 is pressed inward in the radial direction by first inner peripheral surface 25 and elastically deformed. The direction A in FIG. 5 shows the moving direction of handle 1 relative to barrel 2. When protrusion 35 reaches depression 24, the restoration force of the elastically deformed second portion 32 causes protrusion 35 to be fitted in depression 24. Thus, handle 1, barrel 2, and first damping section 3 are aligned with each other.

Fourth, second damping section 4 is provided on the combination of handle 1, barrel 2, and first damping section 3 aligned with each other. For example, second damping section 4 is formed by any method such as injection molding and thereafter passed onto straight tube portion 11 from the proximate end 1A side of handle 1 and attached to the combination of handle 1, barrel 2, and first damping section 3. Second damping section 4 may be formed on the combination by overmolding.

Accommodated portion 41 of second damping section 4 comes into contact with each of handle 1, barrel 2, and first damping section 3. Thus, handle 1, barrel 2, first damping section 3, and second damping section 4 are aligned with each other.

Fifth, knob 1A1 is attached to proximate end 1A of handle 1. Further, closing portion 23 is attached to the distal end of straight tube portion 21 of barrel 2.

Bat 100 can be manufactured in this way.

<Evaluation Test of Material of First Damping Section>

In this test, specimens 1 to 7 were prepared as candidates for the material of the first damping section, and the D hardness and the loss coefficient tan δ of each of specimens 1 to 7 were evaluated.

Specimens 1 to 7 prepared were different only in constituent materials. The material of specimen 1 was S133 manufactured by TORAY INDUSTRIES, INC. The material of specimen 2 was PA11/BMNO17 manufactured by Arkema K. K. The material of specimen 3 was AZ3/2 manufactured by Ems-Chemie Ltd. The material of specimen 4 was U328TL manufactured by TORAY INDUSTRIES, INC. The material of specimen 5 was 6 natural manufactured by Ensinger. The material of specimen 6 was Tecanat natural rod (polycarbonate) manufactured by Ensinger. The material of specimen 7 was SBR70A (hard rubber) manufactured by Vert Plastic.

The D hardness was measured based on the durometer D hardness measurement method defined by JIS K7215 (1986).

The loss coefficient tan δ measured with the amount of strain 3000 μST, a temperature of 20° C., and a frequency of 150 Hz and the loss coefficient tan δ measured with the amount of strain 3000 μST, a temperature of 20° C., and a frequency of 500 Hz were determined based on the viscoelasticity testing method defined by JIS K7244 (2007) A dynamic viscoelasticity testing apparatus (model: Rheogel-E4000) manufactured by UBM was used as a measuring device.

Each of specimens 1 to 7 was formed in a strip having a width of approximately 1.5 mm, a thickness of 1.5 mm, and a length of 20 mm or more. Each of specimens 1 to 7 was set in the tensile test chucks of the dynamic viscoelasticity test device such that the chuck-to-chuck distance was 20 mm. The test temperature was set to −50° C. to 40° C., the temperature increase rate was 2° C./min, and the step temperature was 2° C. A sinusoidal distortion having a frequency of 10 Hz, 30 Hz, 50 Hz, 70 Hz, 90 Hz, 110 Hz, 128 Hz and an amplitude of 60 μm was applied to each of specimens 1 to 7. That is, the amount of strain (the ratio of the amplitude of distortion to the length of the specimen) of each specimen was 3000 μST. Under the conditions above, the temperature dependency and the frequency dependency of the storage modulus E' and the loss modulus E" of each of specimens 1 to 7 were determined. Based on the measurement result, the storage modulus E', the loss modulus E", and the loss coefficient tan δ as the ratio of the loss modulus E" to storage modulus E' at a temperature of 20° C., a frequency of 150 Hz, and the amount of strain 3000 μST were calculated. Furthermore, based on the measurement result, the storage modulus E', the loss modulus E", and the loss coefficient tan δ as the ratio of the loss modulus E" to the storage modulus E' at a temperature of 20° C., a frequency of 500 Hz, and the amount of strain 3000 μST were calculated.

The D hardness and the loss coefficient tan δ of each of specimens 1 to 7 are listed in Table 1. Furthermore, the relation between the D hardness and the loss coefficient tan δ of each of specimens 1 to 7 are depicted in FIG. 6 and FIG. 7.

TABLE 1

| | D hardness | tanδ 150 Hz | tanδ 500 Hz |
|---|---|---|---|
| Specimen 1 | 75 | 0.16 | 0.15 |
| Specimen 2 | 75 | 0.13 | 0.11 |
| Specimen 3 | 65 | 0.12 | 0.11 |
| Specimen 4 | 70 | 0.11 | 0.09 |
| Specimen 5 | 75 | 0.11 | 0.09 |
| Specimen 6 | 85 | 0.06 | 0.05 |
| Specimen 7 | 35 | 0.25 | 0.28 |

Figure 6:
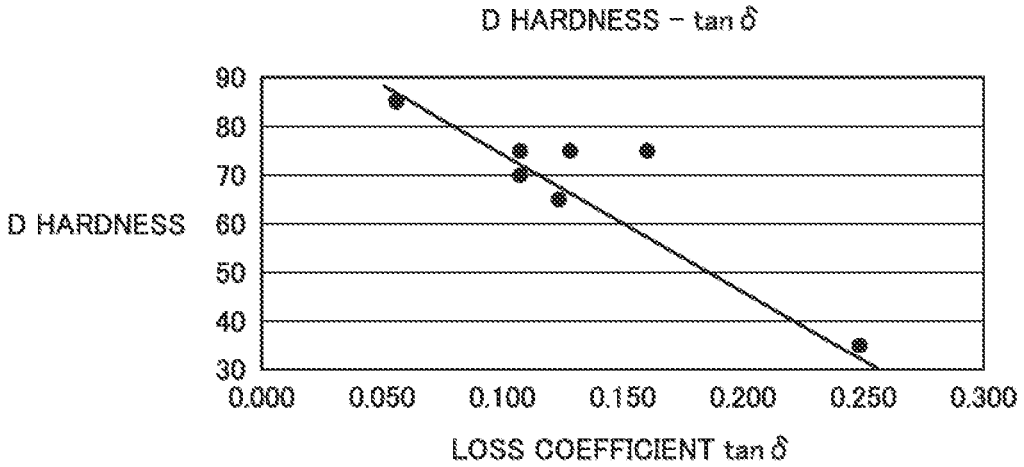
FIG. 6 is a graph showing the relation between the loss coefficient tan δ of specimens 1 to 7 measured with the amount of strain 3000 μST, a temperature of 20° C., and a frequency of 150 Hz and the Shore D hardness of specimens 1 to 7 in an evaluation test for materials of the first damping section.
Figure 7:
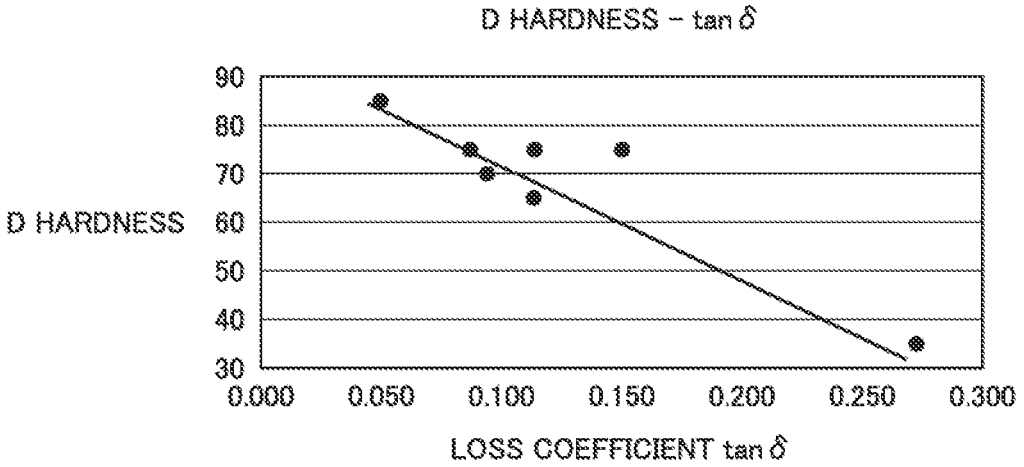
FIG. 7 is a graph showing the relation between the loss coefficient tan δ of specimens 1 to 7 measured with the amount of strain 3000 μST, a temperature of 20° C., and a frequency of 500 Hz and the Shore D hardness of specimens 1 to 7 in an evaluation test for materials of the first damping section.

The straight line in FIG. 6 and FIG. 7 indicates the relational expression obtained from the D hardness and the loss coefficient tan δ of specimens 4 and 6 to 7. For specimen 6 made of polycarbonate, the D hardness was 65 or more, but the loss coefficient tan δ at a frequency of 150 Hz and the loss coefficient tan δ at a frequency of 500 Hz were both 0.06 or less. On the other hand, for specimen 7 made of hard rubber, the D hardness was as low as 35, but the loss coefficient tan δ at a frequency of 150 Hz and the loss coefficient tan δ at a frequency of 500 Hz were both 0.25 or more. As indicated by the straight line in FIG. 6 and FIG. 7, in general, a material having a higher D hardness has a lower loss coefficient tan δ.

In comparison, for specimens 1 to 5, the D hardness was 65 or more, the loss coefficient tan δ at a frequency of 150 Hz was 0.11 or more, and the loss coefficient tan δ at a frequency of 500 Hz was 0.09 or more.

The results in this test suggested that the feel of striking a ball with a bat having the first damping section made of the same material as any of specimens 1 to 5 was hard compared with the feel of striking a ball with the conventional bat having the first damping section made of a material having a Shore A hardness of 70 to 100. Furthermore, it was also suggested that with a bat having the first damping section made of the same material as any of specimens 1 to 5, numbness and pain in hands that the user feels when striking a ball can be reduced compared with the conventional bat.

<Modal Testing of Bat Having First Damping Section>

In this test, prototypes 1 to 3 were prepared as bats each having the first damping section but different only in the material of the first damping section, and modal testing was conducted for prototypes 1 to 3.

The material of the first damping section of prototype 1 was the same material as specimen 1. The material of the first damping section of prototype 2 was the same material as specimen 5. The material of the first damping section of prototype 3 was the same material as specimen 6.

In modal testing, each of prototypes 1 to 3 was suspended by a rubber string connected to the distal end of the bat and a rubber string connected to the vicinity of the proximate end (knob) of the bat and set in a free support state in which the center axis of the bat extends in the horizontal direction. An accelerometer was affixed at a position 100 mm from the proximate end of the handle of each of prototypes 1 to 3. An impulse force was applied by an impact hammer successively to a total of 16 points positioned on a straight line overlapping the center axis in a side view and at 50 mm intervals from the distal end of the bat. The acceleration response at each impulse was measured by the accelerometer.

Based on the measurement results, the natural frequency and the damping ratio of the first bending mode of each of prototypes 1 to 3 and the natural frequency and the damping ratio of the second bending mode of each of prototypes 1 to 3 were estimated.

The results of the modal testing are listed in Table 2.

<Batting Test Using Bat Having First Damping Section>

In this test, sensory evaluation was performed using prototypes 1 to 3 to evaluate the feel of striking and the degree of numbness and pain in hands when a ball was struck with the straight tube portion of the barrel in this evaluation, six participants made an evaluation on a three-point scale.

The results of the batting test are also listed in Table 2. An evaluation value in the batting test listed in Table 2 is the average of the evaluation values given by the participants on a five-point scale. "A" in Table 2 indicates 4 or higher points on the 5-point scale and a high evaluation, "B" in Table 2 indicates 3 points on the 5-point scale and an intermediate evaluation, and "C" in Table 2 indicates 2 or lower points on the 5-point scale and a poor evaluation.

TABLE 2

| | Material of first damping section | First bending mode Natural frequency | First bending mode Damping ratio | Second bending mode Natural frequency | Second bending mode Damping ratio | Batting test |
|---|---|---|---|---|---|---|
| Prototype 1 | Same as specimen 1 | 125 Hz | 2.33 | 470 Hz | 1.75 | A |
| Prototype 2 | Same as specimen 5 | 130 Hz | 1.82 | 484 Hz | 1.28 | B |
| Prototype 3 | Same as specimen 6 | 126 Hz | 1.42 | 510 Hz | 0.80 | C |

As shown in Table 2, according to the results of the modal testing, the loss coefficient tan δ and the damping ratio of prototypes 1 and 2 were higher than the loss coefficient tan δ and the damping ratio of prototype 3 in both of the first bending mode and the second bending mode. Furthermore, the loss coefficient tan δ and the damping ratio of prototype 1 were higher than the loss coefficient tan δ and the damping ratio of prototype 2 in both of the first bending mode and the second bending mode. Actually, in the batting test, numbness and pain in hands that the participants felt when striking a ball using prototype 1 was significantly reduced compared with numbness and pain in hands that the participants felt when striking a ball using prototype 3. Furthermore, numbness and pain in hands that the participants felt when striking a ball using prototype 2 was also significantly reduced compared with numbness and pain in hands that the participants felt when striking a ball using prototype 3.

According to the results in the batting test, the feel of striking using prototypes 1 and 2 was harder than the feel of striking using prototype 3. The feel of striking using prototype 1 was harder than the feel of strike using prototype 2. Accordingly, the evaluation of prototypes 1 and 2 in the batting test was higher than the evaluation of the feel of striking with prototype 3, and the evaluation of prototype 1 in the batting test was even higher than the evaluation of prototype 2 in the batting test.

<Estimation of Damping Ratio of Bat Having First Damping Section>

The results of the modal testing above indicated that the loss coefficient tan δ of the first damping section and the damping ratio of the bat having the first damping section have a positive correlation and the correlation coefficient was high. Then, using the correlation coefficient obtained from the results of the modal testing, the damping ratio of a bat having the first damping section using each of specimens 2 to 4 and 7 other than specimens 1, 5, and 6 used in prototypes 1 to 3 was estimated.

Figure 8:
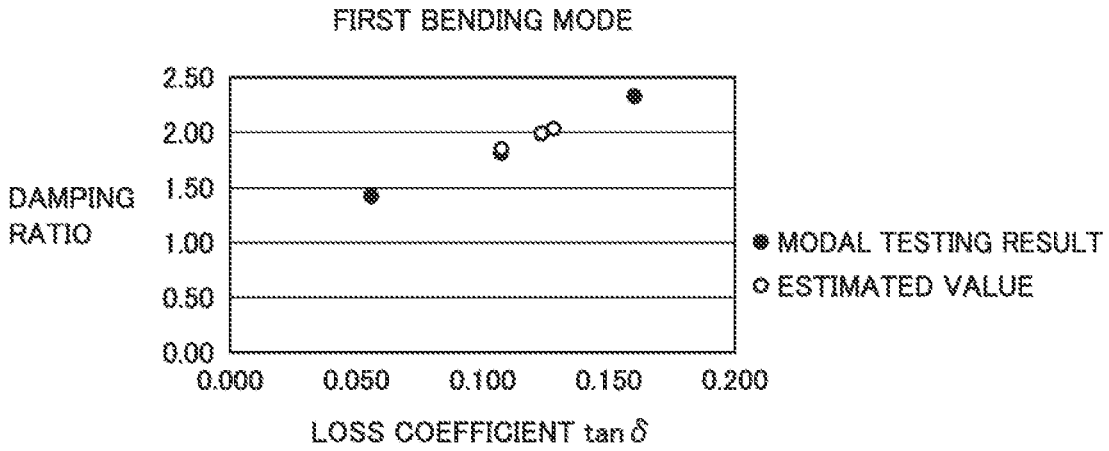
FIG. 8 is a graph in which black circles show the relation between the loss coefficient tan δ of specimens 1, 5, and 6 measured with the amount of strain 3000 μST, a temperature of 20° C., and a frequency of 150 Hz in viscoelasticity testing and the damping ratio of prototypes 1 to 3 measured in modal testing for bat prototypes 1 to 3 having the first damping sections made of the same materials as specimens 1, 5, and 6, and white circles show the damping ratio in a first bending mode of bats having the first damping sections made of the same materials as specimens 2 to 4 and 7, as estimated from the loss coefficient tan δ of specimens 2 to 4 and 7 measured with the amount of strain 3000 μST, a temperature of 20° C., and a frequency of 150 Hz in viscoelasticity testing, based on the relation between the loss coefficient measured in viscoelasticity testing and the damping ratio measured in modal testing shown by the black circles in FIG. 8.

Specifically, the damping ratio in the first bending mode of each of a model 1 having the first damping section made of the same material as specimen 2, a model 2 having the first damping section made of the same material as specimen 3 a model 3 having the first damping section made of the same material as specimen 4, and a model 4 having the first damping section made of the same material as specimen 7, as well as the damping ratio in the second bending mode of each of prototypes 1 to 3 were estimated from the loss coefficient tan δ of specimens 2 to 4 and 7 measured as described above, using the correlation coefficient obtained in the modal testing. The white circles in FIG. 8 show the damping ratio in the first bending mode of the models as estimated as described above. The white circles in FIG. 9 show the damping ratio in the second bending mode of the models as estimated as described above.

Figure 9:
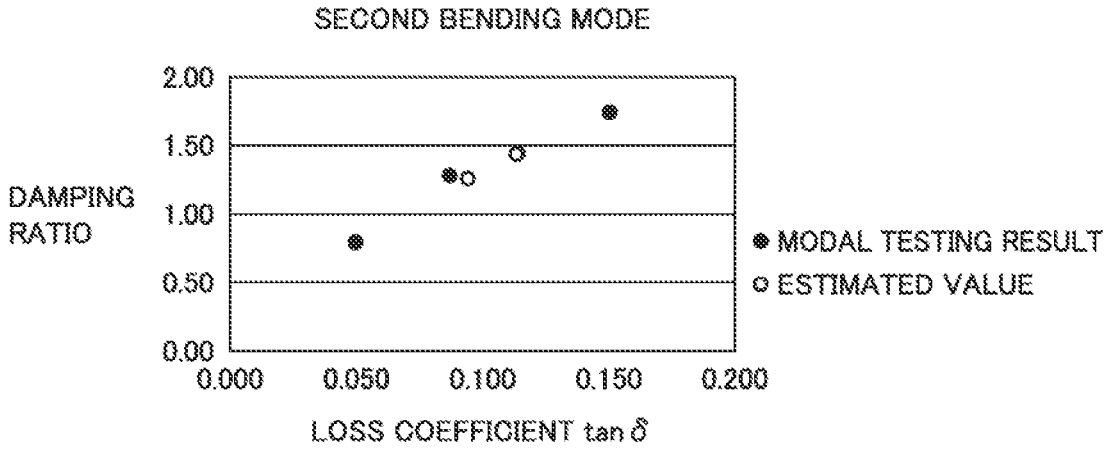
FIG. 9 is a graph in which black circles show the relation between the loss coefficient tan δ of specimens 1, 5, and 6 measured with the amount of strain 3000 μST, a temperature of 20° C., and a frequency of 500 Hz in viscoelasticity testing and the damping ratio of prototypes 1 to 3 measured in modal testing for bat prototypes 1 to 3 having the first damping sections made of the same materials as specimens 1, 5, and 6, and white circles show the damping ratio in a second bending mode of bats having the first damping sections made of the same materials as specimens 2 to 4 and 7, as estimated from the loss coefficient tan δ of specimens 2 to 4 and 7 measured with the amount of strain 3000 μST, a temperature of 20° C., and a frequency of 500 Hz in viscoelasticity testing, based on the relation between the loss coefficient measured in viscoelasticity testing and the damping ratio measured in modal testing shown by the black circles in FIG. 9.

The graphs in FIG. 8 and FIG. 9 suggest that when the material of the first damping section is specimens 1 to 5, the damping ratio in the first bending mode of the bat is higher than 1.50 and the damping ratio in the second bending mode of the bat is also higher than 1.00. That is, FIG. 8 and FIG. 9 suggest that in a bat having the first damping section containing a material having a D hardness of 65 or more, a loss coefficient tan δ of 1.10 or more in the first bending mode, and a loss coefficient tan δ of 0.90 or more in the second bending mode, the damping ratio in the first bending mode and the second bending mode is high and numbness and pain in hands that the user feels when striking a ball is reduced, compared with a bat having the first damping section containing a material having a D hardness of 65 or more, a loss coefficient tan δ of less than 1.10 in the first bending mode, and a loss coefficient tan δ of less than 0.90 in the second bending mode <Modifications>

First damping section 3 and second damping section 4 may be bonded to at least one of handle 1 and barrel 2 by any adhesive material.

Figure 10:
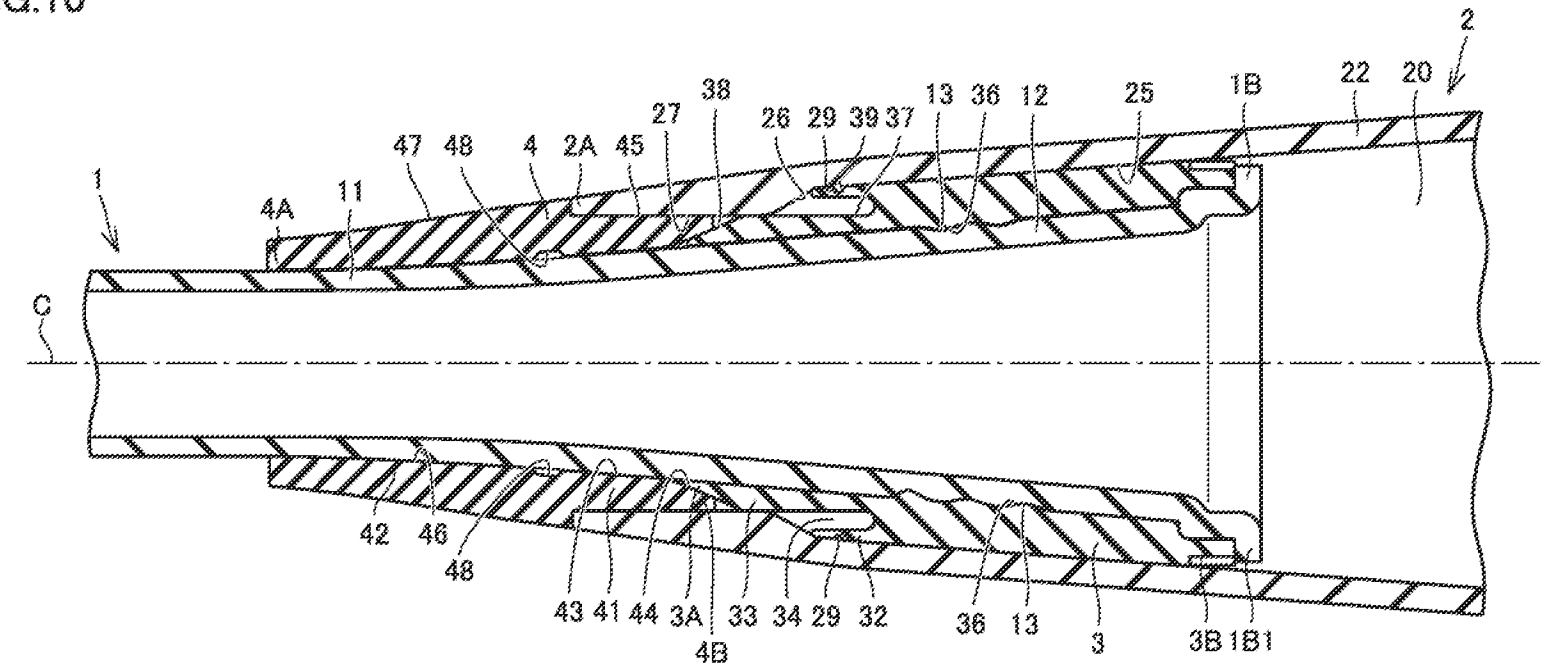
FIG. 10 is an enlarged cross-sectional view of a modification of the bat shown in FIG. 1 to FIG. 4.

As shown in FIG. 10, in a cross section along the center axis C, diameter-decreasing portion 22 of barrel 2 may have a protrusion 29 protruding relative to the inner peripheral surface, and second portion 32 of first damping section 3 may have a depression 39 depressed relative to the outer peripheral surface. Protrusion 29 and depression 39 are fitted together.

Although some possible embodiments are disclosed above, embodiments of the present invention are not limited as such. For example, other appropriate materials and configurations may be selected without departing from the technical spirit of embodiments of the present invention. The positions and configurations used in various features of embodiments of the present invention may be changed as appropriate according to particular bat size and weight, particular specifications, or simply users preference. Such modifications are intended to be embraced in the scope of the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A bat comprising:

a handle having a proximate end, a distal end, and a thread groove;

a barrel having a hollow portion that accommodates the distal end; and a first damping section at least partially sandwiched between the handle and the barrel in an interior of the hollow portion, the first damping section comprising a first portion in contact with each of the handle and the barrel in the interior of the hollow portion, the first portion comprising a thread ridge disposed at least partially within the thread groove of the handle, wherein a material of the first damping section has a D hardness of 60 or more, a loss coefficient tan δ of 0.11 or more as determined under conditions of a temperature of 20° C., a frequency of 150 Hz, and the amount of strain 3000 μST and a loss coefficient tan δ of 0.09 or more as determined under conditions of a temperature of 20° C., a frequency of 500 Hz, and the amount of stain 3000 μST.

2. The bat according to claim 1, further comprising a second damping section disposed closer to the proximate end than the first damping section and at least partially sandwiched between the handle and the barrel in the interior of the hollow portion, wherein a material of the second damping section has a D hardness lower than a Shore D hardness of the material of the first damping section.

3. The bat according to claim 2, wherein the material of the second damping section has an A hardness of 20 to 100.

4. The bat according to claim 3, wherein the material of the second damping section has an A hardness of 20 to 40.

5. The bat according to claim 1, wherein the first damping section includes:

a second portion disposed closer to the proximate end than the first portion, the second portion being in contact with an inner peripheral surface of the barrel and not being in contact with an outer peripheral surface of the handle, in a cross section along a center axis of the barrel, the barrel has a depression depressed relative to the inner peripheral surface, and in the cross section, the second portion has a protrusion fitted in the depression.

6. The bat according to claim 5, wherein the first damping section further includes a third portion disposed closer to the proximate end than the first portion and disposed inside of the second portion in a radial direction with respect to the center axis, with a gap interposed between the third portion and the second portion, and the third portion protrudes toward the proximate end relative to the second portion in an axial direction along the center axis.

7. The bat according to claim 6, further comprising a second damping section disposed closer to the proximate end than the first damping section and at least partially sandwiched between the handle and the barrel in the interior of the hollow portion, wherein the second damping section is in contact with each of the handle, the barrel, and the third portion of the first damping section.

8. The bat according to claim 1, further comprising, the loss coefficient tan δ of the material of the first damping section is between 0.11 to 0.16 as determined under conditions of a temperature of 20° C., a frequency of 150 Hz, and the amount of strain 3000 μST and the loss coefficient tan δ is between 0.09 to 0.15 as determined under conditions of a temperature of 20° C., a frequency of 500 Hz, and the amount of strain 3000 μST.

9. A bat comprising:

a handle having a proximate end and a distal end;

a barrel having a hollow portion that accommodates the distal end; and a first damping section at least partially sandwiched between the handle and the barrel in an interior of the hollow portion, the first damping section comprising:

a first portion in contact with each of the handle and the barrel in the interior of the hollow portion, a second portion disposed nearer the proximate end than the first portion, the second portion being in contact with an inner peripheral surface of the barrel and not being in contact with an outer peripheral surface of the handle, and a third portion disposed nearer the proximate end than the first portion and disposed at least partially inside of the second portion in a radial direction with respect to a center axis of the barrel, a gap in the radial direction being interposed between the third portion and the second portion, in a cross section along the center axis of the barrel, the barrel having a depression depressed relative to the inner peripheral surface, in the cross section, the second portion having a protrusion fitted in the depression, and the third portion protruding toward the proximate end relative to the second portion in an axial direction along the center axis, wherein a material of the first damping section has a D hardness of 60 or more, a loss coefficient tan δ of 0.11 or more as determined under conditions of a temperature of 20° C., a frequency of 150 Hz, and the amount of strain 3000 μST and a loss coefficient tan δ of 0.09 or more as determined under conditions of a temperature of 20° C., a frequency of 500 Hz, and the amount of strain 3000 μST.

10. The bat according to claim 9, further comprising a second damping section disposed closer to the proximate end than the first damping section and at least partially sandwiched between the handle and the barrel in interior of the hollow portion, wherein a material of the second damping section has a D hardness lower than a Shore D hardness of the material of the first damping section.

11. The bat according to claim 10, wherein the material of the second damping section has an A hardness of 20 to 100.

12. The bat according to claim 11, wherein the material of the second damping section has an A hardness of 20 to 40.

13. The bat according to claim 9, wherein the handle comprises a thread grove, and the first portion comprises a thread ridge disposed within the thread grove of the handle.

14. The bat according to claim 9, further comprising a second damping section disposed closer to the proximate end than the first damping section and at least partially sandwiched between the handle and the barrel in interior of the hollow portion, wherein the second damping section is in contact with each of the handle, the barrel, and the third portion of the first damping section.

15. The bat according to claim 9, further comprising, the loss coefficient tan δ of the material of the first damping section is between 0.11 to 0.16 as determined under conditions of a temperature of 20° C., a frequency of 150 Hz, and the amount of strain 3000 μST and the loss coefficient tan δ is between 0.09 to 0.15 as determined under conditions of a temperature of 20° C., a frequency of 500 Hz, and the amount of strain 3000 μST.

* * * * *